United States Patent [19]

Dobrosielski et al.

[11] 4,136,924

[45] Jan. 30, 1979

[54] TERMINAL CONNECTOR

[75] Inventors: Stephen S. Dobrosielski, Beaver; Stephen G. Layciak, Brighton Township, Beaver County; Robert J. Johnston, Patterson Heights, all of Pa.

[73] Assignee: Westinghouse Electric Corp., Pittsburgh, Pa.

[21] Appl. No.: 858,324

[22] Filed: Dec. 7, 1977

[51] Int. Cl.[2] ..... H01R 11/26

[52] U.S. Cl. ..... 339/263 R; 24/135 R

[58] Field of Search ..... 339/242, 246, 249 A, 339/263, 266, 272; 24/135 R, 263 A

[56] References Cited

U.S. PATENT DOCUMENTS

| | | | |
|---|---|---|---|
| 3,638,172 | 1/1972 | Adam | 339/272 R |
| 3,747,052 | 7/1973 | Sheldon | 339/272 UC |
| 3,803,538 | 4/1974 | Hirano et al. | 339/263 R |

FOREIGN PATENT DOCUMENTS

| | | | |
|---|---|---|---|
| 1064584 | 9/1959 | Fed. Rep. of Germany | 339/263 R |

*Primary Examiner*—Joseph H. McGlynn
*Attorney, Agent, or Firm*—L. P. Johns

[57] ABSTRACT

A terminal connector characterized by a terminal conductor, a U-shaped terminal clamp mounted on and straddling the conductor, the conductor having an aperture and the terminal clamp having a tapped hole, a clamp screw extending through the aperture and seated in the tapped hole, and the conductor and the clamp having interengaging means for preventing separation when the screw is removed.

1 Claim, 3 Drawing Figures

TERMINAL CONNECTOR

CROSS-REFERENCE TO RELATED APPLICATIONS

This application is related to copending applications of W. J. Kellogg, Ser. No. 858,326, filed Dec. 7, 1977; R. J. Johnston et al., Ser. No. 858,323, filed Dec. 7, 1977; and R. J. Johnston et al., Ser. No. 858,325, filed Dec. 7, 1977.

BACKGROUND OF THE INVENTION

1. Field of the Invention

This invention relates generally to electric control switches, and more particularly, it pertains to a unique terminal connector.

2. Description of the Prior Art

Terminal clamps of prior construction have not been completely satisfactory. One problem has been complete separation of the terminal conductor and the clamp when the clamping screw is removed, thereby creating a problem of reassembly when the screw is reattached, which is usually in close quarters. In addition, prior clamping screws have been seated in a tapped hole in the conductor so that the clamp moves freely until it is tightened in place by the screw. Associated with the foregoing has been the problem of using a terminal connector which is useful with solid or stranded bare wire as well as a ring-type connector.

SUMMARY OF THE INVENTION

It has been found in accordance with this invention that a terminal connector may be provided which comprises a terminal conductor, a terminal clamp, and a terminal screw; the conductor having a hole therethrough and notches on either side thereof, the clamp having a U-shaped cross-section and including an intermediate portion and U-legs on each side of the portion, the intermediate portion having a tapped hole, the conductor being disposed between the U-legs, and the tapped hole being aligned with the hole in the conductor, the screw being seated in the tapped hole with the head of the screw being disposed on the opposite side of the conductor from the clamp, the U-legs on either side extending through and being slidably mounted in the notches so that when the screw is removed the clamps and the conductor remain unseparated.

The advantage of the device of this invention is that it facilitates the insertion of a wire or ring type conductor on the clamp and the tightening in place thereof, and generally facilitates the connection of wire leads to a terminal.

DESCRIPTION OF THE PREFERRED EMBODIMENTS

Figure 1:
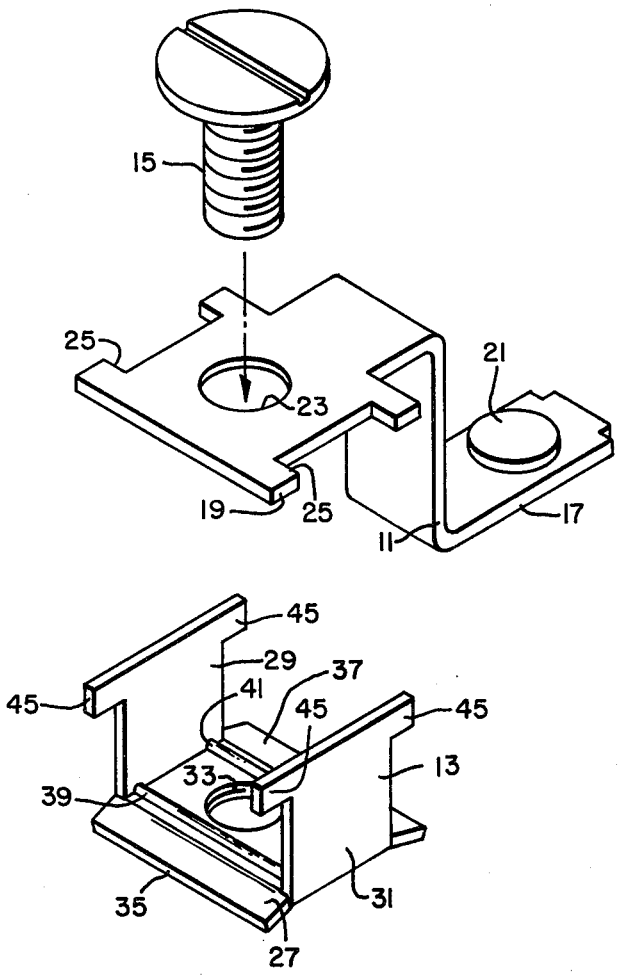
FIG. 1 is an exploded view of a terminal connector embodying the principal features of the invention.

In FIG. 1 a terminal connector is shown which comprises a terminal conductor 11, a terminal clamp 13, and a terminal screw 15. The conductor 11 may be of any suitable configuration, such as the generally Z-shape shown in FIG. 1. The conductor 11 may have any other configuration, such as planar. The conductor 11 includes end portions 17 and 19 with an electrical contact 21 mounted on the end portion 17. Thus, the connector may be used in conjunction with an electrical switch (not shown).

The end portion 19 has an aperture means or hole 23 through which the terminal screw 15 extends. In addition, the end portion 19 comprises opening means or notches 25 disposed along opposite edges of the end portion 19 and preferably on opposite sides of the hole 23.

Figure 2:
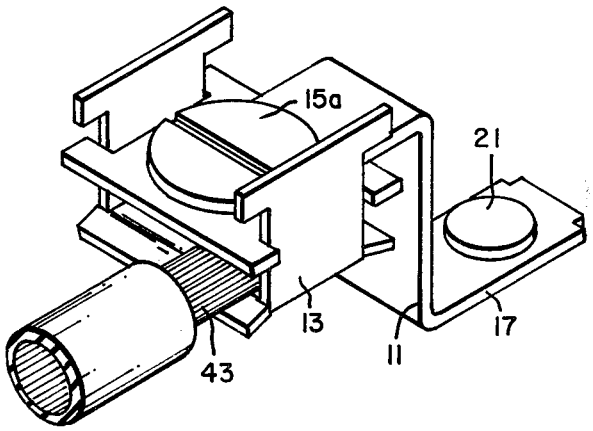
FIG. 2 is an isometric view of the connector as used with a wire conductor.

The terminal clamp 13 is a channel or U-shaped member comprising an intermediate portion or base 27 and upturned legs 29, 31. The base 27 comprises a tapped or threaded hole 33 for receiving the threaded screw 15. In addition, the base 27 includes a pair of similar flanges 35, 37 extending from opposite sides thereof and disposed at a slight angle to facilitate insertion of a conductor wire and the like during connection. Finally, the base has a pair of transverse ribs 39, 41 for stiffening a conductor wire 43 (FIG. 2) between the clamp to enable a high torque application by the screw and to "bite" the wire to secure it against pull-out.

The legs 29, 31, extending upright from the plane of the base 27 fit snugly into the notches 25 (FIG. 2) where they are slidably disposed. The legs 29, 31 also include upper outturned ears 45 extending beyond the opposite ends of their corresponding notches 25 to prevent inadvertent separation of the clamp and conductor.

When assembled (FIG. 2) the terminal connector is normally used with a conductor wire 43 which is clamped between the base 27 and the end portion 19 of the conductor 30. The terminal screw 15 has threaded engagement with the tapped hole 33 of the clamp and merely passes through the hole 23 of the conductor. Accordingly, when the screw 15 is tightened in place, the screw head **15*a* is disposed against the conductor and the clamp 13 is drawn up tightly to hold the wire 43 in place. In this manner the terminal connector is used with the solid or stranded wire 43** type of conductor.

Figure 3:
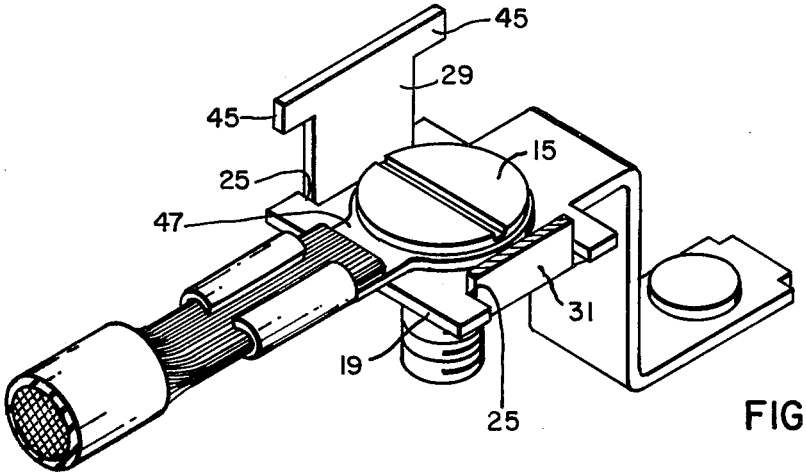
FIG. 3 is an isometric view of the terminal connector when used with a ring connector.

The terminal connector is also suitable for use with a ring connector 47 as shown in FIG. 3. For that purpose the screw 15 is completely removed from the holes 23, 33 to enable placement of the ring connector 47 in alignment with the hole 23. The screw 15 is then replaced in the holes and tightened in place with the tapped hole 23 of the clamp 13 serving as a nut for the screw 15.

Accordingly, the terminal connector satisfies the requirements of a connector to be used with either a wire or ring-type conductor, or both. The advantage of this unique terminal connector is that the clamp 13 is captive in assembly with the connector 19 and travels with the rotation of the screw 15 so that the bare wires may be easily inserted between the clamp 13 and the conductor 11. The clamp 13 is also captive on the connector so that the terminal screw 15 may be removed for addition of a ring-type connector 47.

What is claimed is:

1. A terminal connector comprising a terminal conductor, a clamp, and a screw; the conductor having aperture means therethrough, the clamp having a U-shaped cross section including a base and legs on each side of the base, the conductor being disposed between the legs, the base having tapped hole means, the tapped hole means being aligned with the aperture means, the screw having a threaded shaft and a head, the threaded shaft engaging the tapped hole means and the head engaging the conductor on the side opposite the clamp, the conductor and clamp comprising mutually interengaging means to prevent separation of the conductor and clamp, the interengaging means comprising opening means on the conductor and the legs which are slidably mounted in the opening means, the opening means comprising an edge notch on each opposite edge of the conductor, a leg seated in a corresponding notch, and each leg having a T-shaped end portion.

* * * * *